US006220229B1

(12) United States Patent
Kawamura et al.

(10) Patent No.: US 6,220,229 B1
(45) **Date of Patent: *Apr. 24, 2001**

(54) APPARATUS FOR DETECTING EVAPORATIVE EMISSION CONTROL SYSTEM LEAK

(75) Inventors: Katsuhiko Kawamura; Akihiro Kawano, both of Kanagawa (JP)

(73) Assignee: Nissan Motor Co., Ltd., Yokohama (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/292,933

(22) Filed: Apr. 16, 1999

(30) Foreign Application Priority Data

Apr. 20, 1998 (JP) ..... 10-109395

(51) Int. Cl.[7] ..... F02M 33/04
(52) U.S. Cl. ..... 123/520
(58) Field of Search ..... 123/516, 518, 123/519, 520

(56) References Cited

U.S. PATENT DOCUMENTS 5,158,054 * 10/1992 Otsuka ..... 123/520
5,261,379 * 11/1993 Lipinski et al. ..... 123/520
5,295,472 * 3/1994 Otsuka et al. ..... 123/520
5,327,873 * 7/1994 Ohuchi et al. ..... 123/520
5,333,589 * 8/1994 Otsuka ..... 123/520
5,590,634 * 1/1997 Shinohara ..... 123/520
5,857,447 * 1/1999 Shinohara ..... 123/520

FOREIGN PATENT DOCUMENTS 6-81728 3/1994 (JP) .
7-139439 5/1995 (JP) .

* cited by examiner

*Primary Examiner*—Thomas N. Moulis
(74) *Attorney, Agent, or Firm*—Foley & Lardner

(57) ABSTRACT

There is provided an apparatus for detecting a leak in an evaporative emission control system for an internal combustion engine including a fuel tank, a canister for collecting fuel vapors from the fuel tank, and a purge control valve disposed between the canister and the intake pipe for allowing flow of the fuel vapors from the canister to the intake pipe such that a fuel vapor flow passage is provided which extends from the fuel tank to the purge control valve by way of the canister. The apparatus comprises a vent control valve for selectively opening and closing an atmospheric vent of a canister, an actuating device for actuating the purge control valve and the vent control valve to fully close immediately after the engine starts and thereby closing the fuel vapor flow passage in a way as to prevent communication between an inside and outside of the fuel vapor flow passage, a pressure sensor for detecting a pressure in the fuel vapor flow passage, and a diagnostic device for detecting a leak on the basis of the pressure in the fuel vapor flow passage which reduces with increase of consumption of fuel in the fuel tank after the fuel vapor flow passage is closed.

13 Claims, 6 Drawing Sheets

APPARATUS FOR DETECTING EVAPORATIVE EMISSION CONTROL SYSTEM LEAK

BACKGROUND OF THE INVENTION

1. Field of the Invention

The present invention relates in general to evaporative emission control systems for automotive vehicles and more particularly to an apparatus for determining if a leak is present in an evaporative emission control system for an automotive vehicle.

2. Description of the Related Art

An evaporative emission control system includes a canister containing activated charcoal to collect and store volatile fuel vapors from a fuel tank during the time the engine is not running. The evaporative emission control system also includes a purge line or conduit connecting between an intake pipe portion downstream of a throttle valve and the canister. The purge line opens under a predetermined condition after start of the engine to draw fresh air into the canister and purge the canister. The collected volatile fuel vapors are thus drawn from the canister into the intake pipe, for combustion within a combustion chamber of the engine.

In this instance, if a fuel vapor flow passage extending from the fuel tank to the intake pipe has a leak or the fuel vapor flow passage has a connecting portion of which seal is defective, the fuel vapors are released to the atmosphere. To prevent such evaporative fuel emission, a diagnostic system has been proposed to determine if a leak is present in the evaporative emission control system, as disclosed in Japanese provisional patent publication No. 7-139439. A leak of the above described fuel vapor flow passage can be checked by closing the passage so that the passage is in the form of a closed space, i.e., by closing the passage in a way as to prevent fluid communication between the inside and the outside of the passage, and observing a variation of the internal pressure of the fuel vapor flow passage after the passage is pressurized in such a way that the internal pressure of the passage and the atmospheric pressure differ relatively firm each other. The diagnostic system of the above described publication thus includes a vent control valve provided to an atmospheric vent of the canister to selectively open and close the atmospheric vent. The atmospheric vent of the canister is closed by the vent control valve when the above described passage is to be closed so as to be in the form of a closed space. The diagnostic system also includes a pressure sensor provided to the above described fuel vapor flow passage for checking a pressure variation of gas enclosed in the passage. A negative pressure produced in the intake pipe portion downstream of the throttle valve is introduced into the fuel vapor flow passage for negative pressurization thereof, whereby to check if a leak is present in the passage.

SUMMARY OF THE PRESENT INVENTION

However, if the mixture of air and fuel vapors in the above described passage is drawn by intake vacuum into the intake pipe, variations of the air-fuel ratio of the engine will result. To prevent such variations of the air-fuel ratio, it has heretofore been practiced to conduct a leak detection during a feedback control of the air-fuel ratio. A three way catalytic converter will become most effective when the air-fuel mixture has a stoichiometric ratio or a ratio adjacent thereto. For this reason, the feedback control of the air-fuel ratio is performed on the basis of the output of an oxygen sensor disposed upstream of the three way catalytic converter so that the air-fuel ratio is included within a predetermined range having a stoichiometric ratio at its center. By the feedback control of the air-fuel ratio, it is intended to prevent variations of the air-fuel ratio due to introduction of the mixture of air and fuel vapors into the intake manifold from the above described fuel vapor flow passage.

However, the feedback control of the air-fuel ratio has for its main purpose to eliminate a steady-state deviation due to variations of the flow rate characteristics of an injector and an air flow meter resulting from variations in the manufacture thereof. Thus, the responsive speed of the feedback control is not so high, so the three way catalytic converter cannot be most effective until the air-fuel ratio returns to a value adjacent a stoichiometric ratio after a variation of the air-fuel ratio is caused.

Further, the feedback control of the air-fuel ratio requires the oxygen sensor to have been in an activated condition. Thus, it has heretofore been impossible to conduct the diagnosis of leak before the feedback control of the air-fuel ratio starts (e.g., immediately after the engine starts).

It is accordingly an object of the present invention to provide a leak detection apparatus for an evaporative emission control system for an internal combustion engine which is capable of conducting a diagnosis of leak before the feedback control of the air-fuel ratio starts, for example, immediately after the engine starts.

It is a further object of the present invention to provide a leak detection apparatus of the foregoing character which utilizes consumption of fuel in a fuel tank for attaining negative pressurization of a fuel vapor flow passage extending from a fuel tank to a purge control valve.

To achieve the foregoing objects, the present invention is an apparatus for detecting a leak in an evaporative emission control system for an internal combustion engine including a fuel tank, a canister for collecting fuel vapors from the fuel tank, a purge control valve disposed between the canister and the intake pipe for controlling flow of the fuel vapors from the canister to the intake pipe such that a fuel vapor flow passage is provided which extends from the fuel tank to the purge control valve by way of the canister. The apparatus includes a vent control valve for selectively opening and closing an atmospheric vent of the canister, an actuating device for actuating the purge control valve and the vent control valve to fully close immediately after the engine starts and thereby closing the fuel vapor flow passage in such a way as to prevent communication between an inside and outside of the fuel vapor flow passage, a pressure sensor for detecting a pressure in the fuel vapor flow passage, and a diagnostic device for detecting a leak on the basis of the pressure in the fuel vapor flow passage which reduces with increase of consumption of fuel in the fuel tank after the fuel vapor flow passage is closed.

DETAILED DESCRIPTION OF THE PREFERRED EMBODIMENT

Figure 1:
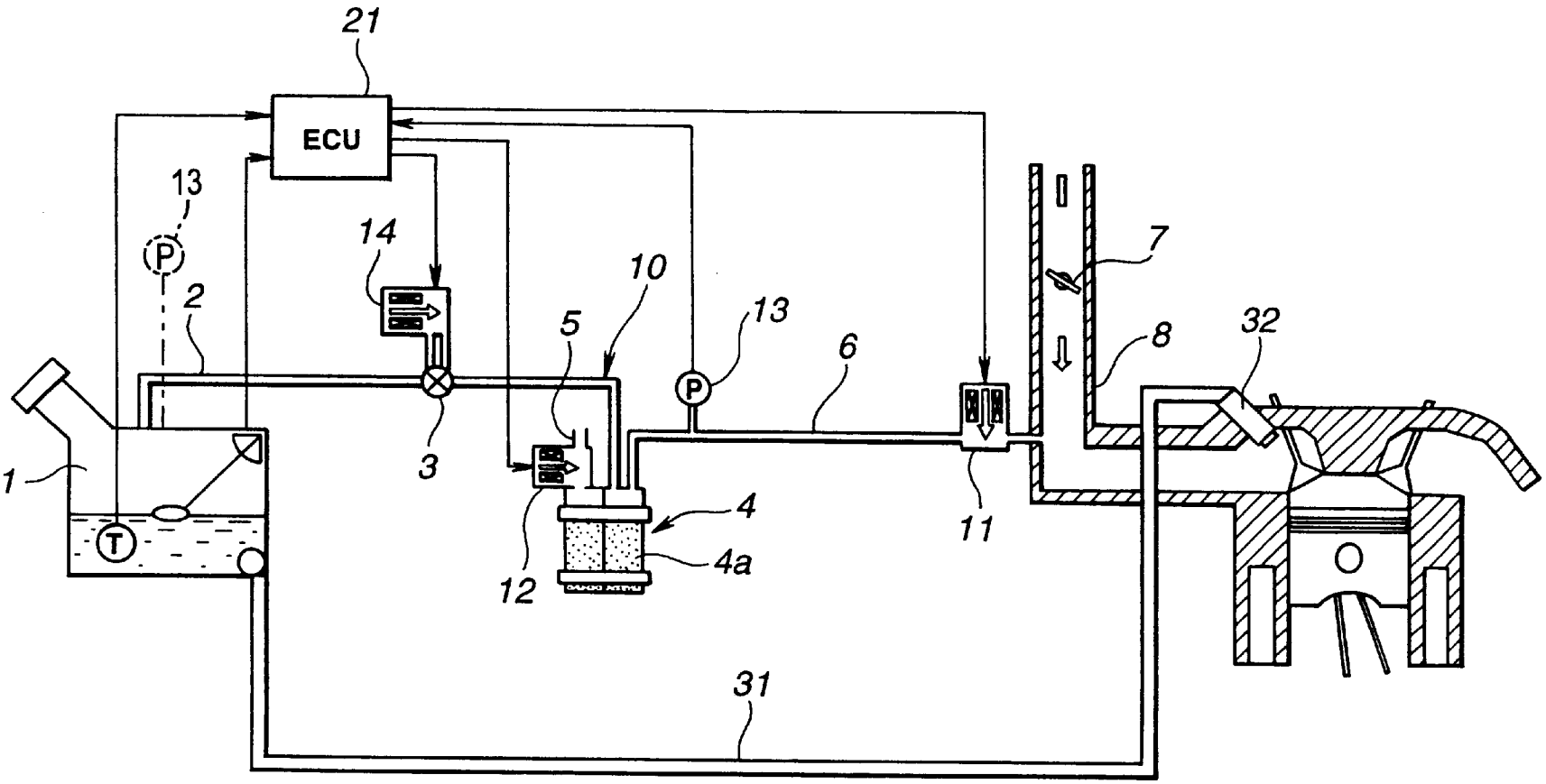
FIG. 1 is a schematic diagram of an evaporative emission control system utilizing a leak detection apparatus according to an embodiment of the present invention.

Referring fist to FIG. 1, there is illustrated the whole arrangement of an evaporative emission control system for an internal combustion engine and a leak detecting apparatus therefor. Indicated by 1 is a fuel tank and by 4 a canister. Fuel vapors and air in the upper part of the fuel tank 1 are drawn through a line (first conduit) 2 into the canister 4. Only the fuel vapors are adsorbed by an activated charcoal 4*a* in the canister 4. The remaining air is discharged to the outside through an atmospheric vent 5 disposed at the lower end portion of the canister 4 (though shown at the upper end portion in the drawing).

Figure 2:
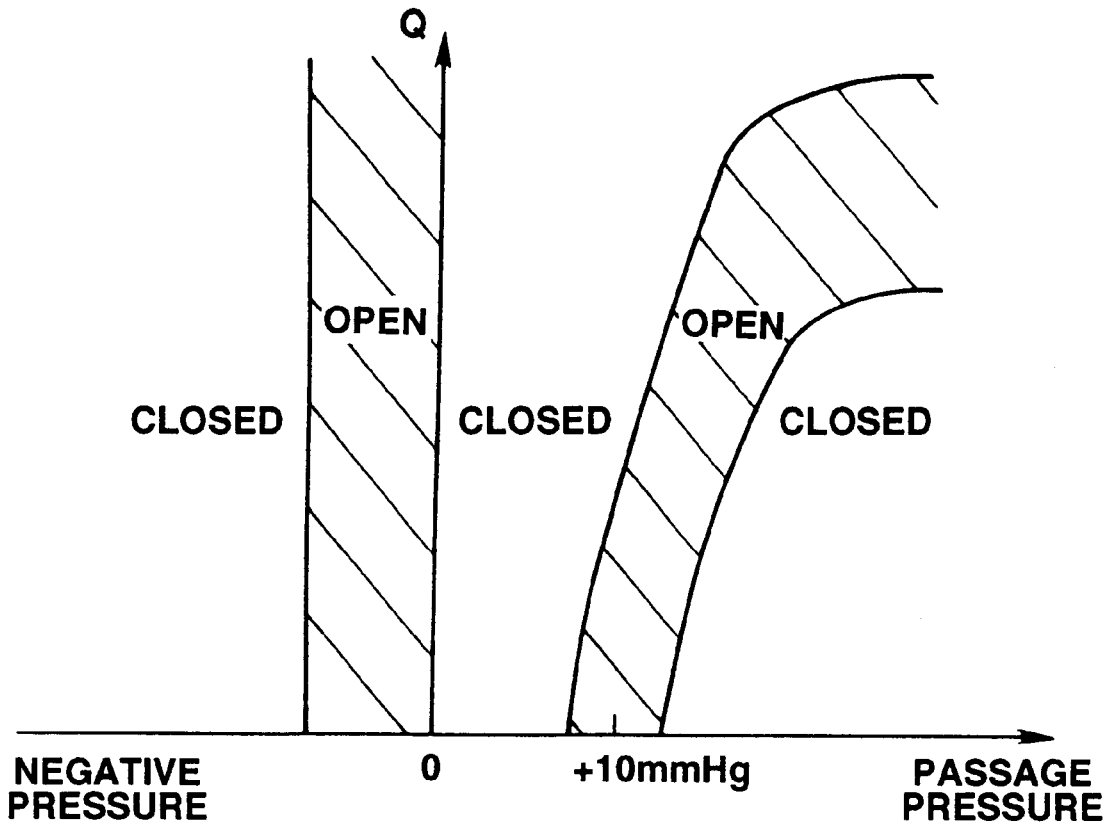
FIG. 2 is a graph of passage pressure against flow rate illustrating operation of a vacuum cut valve of the system of FIG. 1.

A mechanical vacuum cut valve 3 is provided which opens when the pressure in the fuel tank 3 is lower than the atmospheric pressure. FIG. 2 shows the operation of the vacuum cut valve 3. As show in FIG. 2, the vacuum cut valve 3 is also open when the pressure in the fuel tank 1 assumes a predetermined pressure (e.g., +10 mmHg) due to generation of fuel vapors therein. In FIG. 2, on the basis of the atmospheric pressure (i.e., assuming that the atmospheric pressure is 0 mmHg), the pressure higher than the atmospheric pressure is added with "+" and the pressure lower than the atmospheric pressure is added with "−".

The canister 4 is communicated with an air intake pipe 8 portion downstream of a throttle valve 7 through a purge line (second conduit) 6. A normally closed purge control valve 11 driven by a step motor (not shown) is disposed in the purge line 6. Under a predetermined condition (e.g., under a low load condition after warp-up of the engine), the purge control valve 11 opens in response to a signal from an ECU (electronic control unit) 21. Whereupon, fresh air is drawn into the canister 4 through the atmospheric vent 5 by an intake vacuum prevailing in the intake pipe 8 portion downstream of the throttle valve 7. The fuel vapors are thus drawn from the activated charcoal 4*a* together with the fresh air into the intake pipe 8 for combustion in a combustion chamber of the engine.

In the evaporative emission control system, a fuel vapor flow passage 10 is thus provided which extends from the fuel tank 1 to the purge control valve 11 by way of the canister 4, i.e., which is comprised of an inner space of the fuel tank 1, an inner space of the first conduit 2, an inner space of the canister 4, and an inner space of the second conduit 6.

If the fuel vapor flow passage 10 extending from the fuel tank 1 to the purge control valve 11 has a leak or the passage 10 has a connecting portion of which seal is defective, fuel vapors leak out to the atmosphere. To prevent such leakage, it has been proposed to conduct a leak detection by developing a negative pressure in the above described passage by utilizing a vacuum generated in the intake pipe 8 portion downstream of the throttle valve 7.

In this instance, if the mixture of air and fuel vapors in the fuel vapor flow passage 10 is drawn by the intake vacuum into the intake pipe 8, variations of the air-fuel ratio of the engine result. To prevent such variations, it has heretofore been practiced to conduct the leak detection during a feedback control of the air-fuel ratio. A three way catalytic converter is most effective when the air-fuel mixture has a stoichiometric ratio or a ratio adjacent thereto. For this reason, the feedback control of the air-fuel ratio is performed on the basis of the output of an oxygen sensor disposed upstream of the three way catalytic converter so that the air-fuel ratio is included within a predetermined range having a stoichiometric ratio at its center. By the feedback control of the air-fuel ratio, it is intended to prevent variations of the air-fuel ratio due to introduction of the mixture of air and fuel vapors into the intake pipe 8 from the fuel vapor flow passage 10.

However, the responsive speed of the feedback control is not so high, so the three way catalytic converter cannot be most effective until the air-fuel ratio returns to a value adjacent a stoichiometric ratio after a variation of the air-fuel ratio is caused. Further, it is necessary for the oxygen sensor to have been activated before start the feedback control of the air-fuel ratio. Thus, it has been impossible to attain a leak detection before the feedback control of the air-fuel ratio starts (e.g., immediately after the engine starts).

To solve such a problem, the fuel vapor flow passage 10 is negatively pressurized immediately after start of the engine by utilizing a consumption of fuel in the fuel tank according to an embodiment of the present invention.

Firstly, a normally open vent control valve 12 is provided to the atmospheric vent 5 of the canister 4 to close the fuel vapor flow passage 10 extending from the fuel tank 1 to the purge control valve 11 for thereby closing the fuel vapor flow passage 10 so that the passage 10 is in the form of a closed space. Further, the above described vacuum cut valve 3 is provided with a normally closed bypass valve 14 in parallel relation thereto. Accordingly, when the vent control valve 12 and the purge control valve 11 are closed while the bypass valve 14 is opened in response to signals from the control unit 21, the fuel vapor flow passage 10 extending from the fuel tank 1 to the purge control valve 11 establishes communication throughout thereof while being closed so as to be in the form of a closed space, i.e., closed in a way as to prevent communication between the inside and outside of the passage 10.

Figure 3:
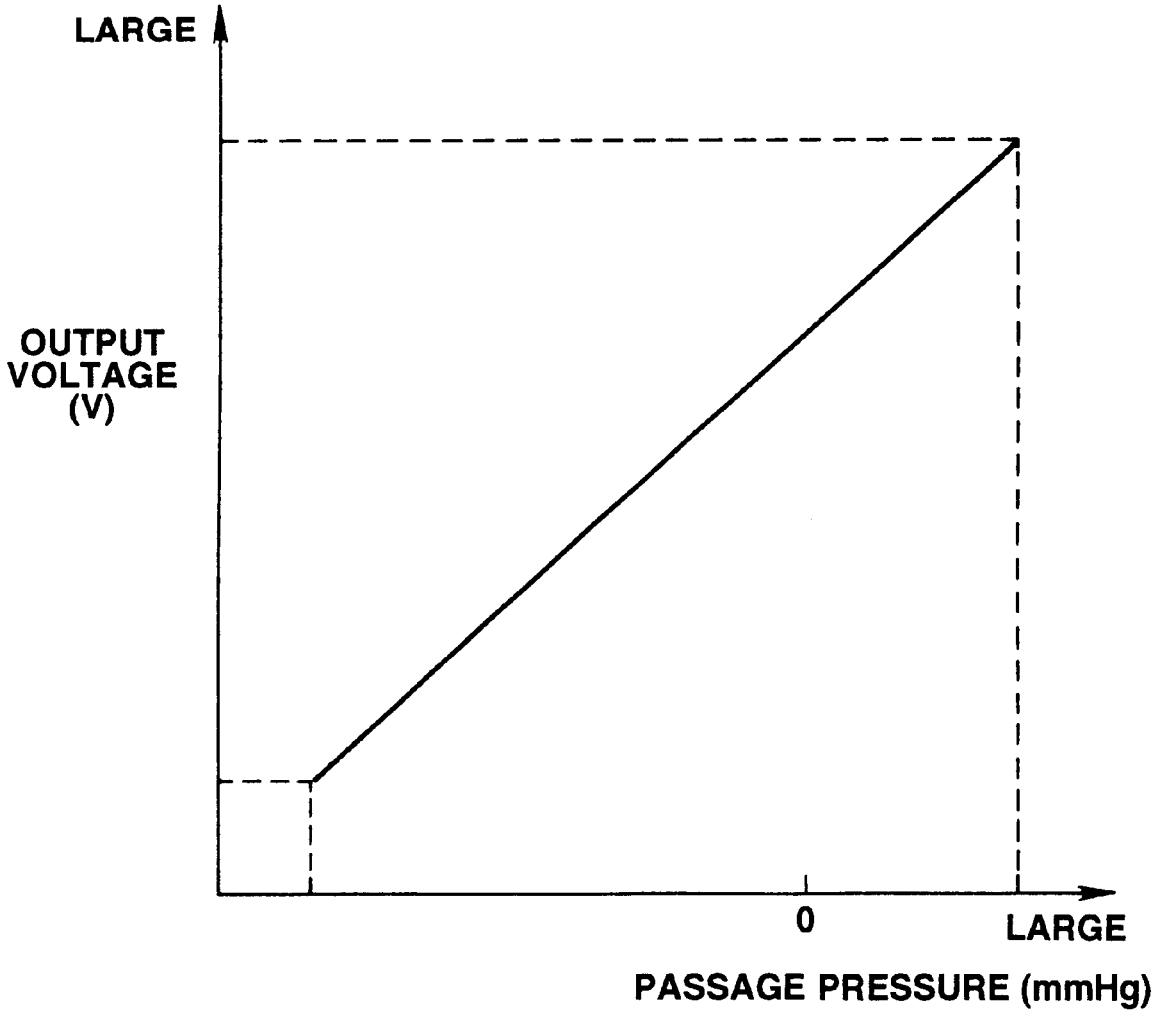
FIG. 3 is a graph of passage pressure against output voltage illustrating operation of a pressure sensor of the apparatus of FIG. 1.

In the purge line 6 between the canister 4 and the purge control valve 11 is disposed a pressure sensor 13. As shown in FIG. 3, the pressure sensor 13 produces as an output a voltage proportional to the pressure (i.e., pressure with respect to the atmospheric pressure) in the fuel vapor flow passage 10 which is closed so as to be in the form of a closed space at the time of leak detection. In the meantime, the pressure sensor 13 can be disposed at any portion of the passage between the fuel tank 1 and the purge control valve 11 or can be disposed at the fuel tank 1 as indicated by the two-dot chain lines.

The control unit 21 is comprised of a microcomputer and controls opening and closing of the above described three valves, i.e., the purge control valve 11, vent control valve 12 and bypass valve 14, whereby to detect if the fuel vapor flow passage 10 extending from the fuel tank 1 to the purge control valve 11 has a leak.

Figure 4:
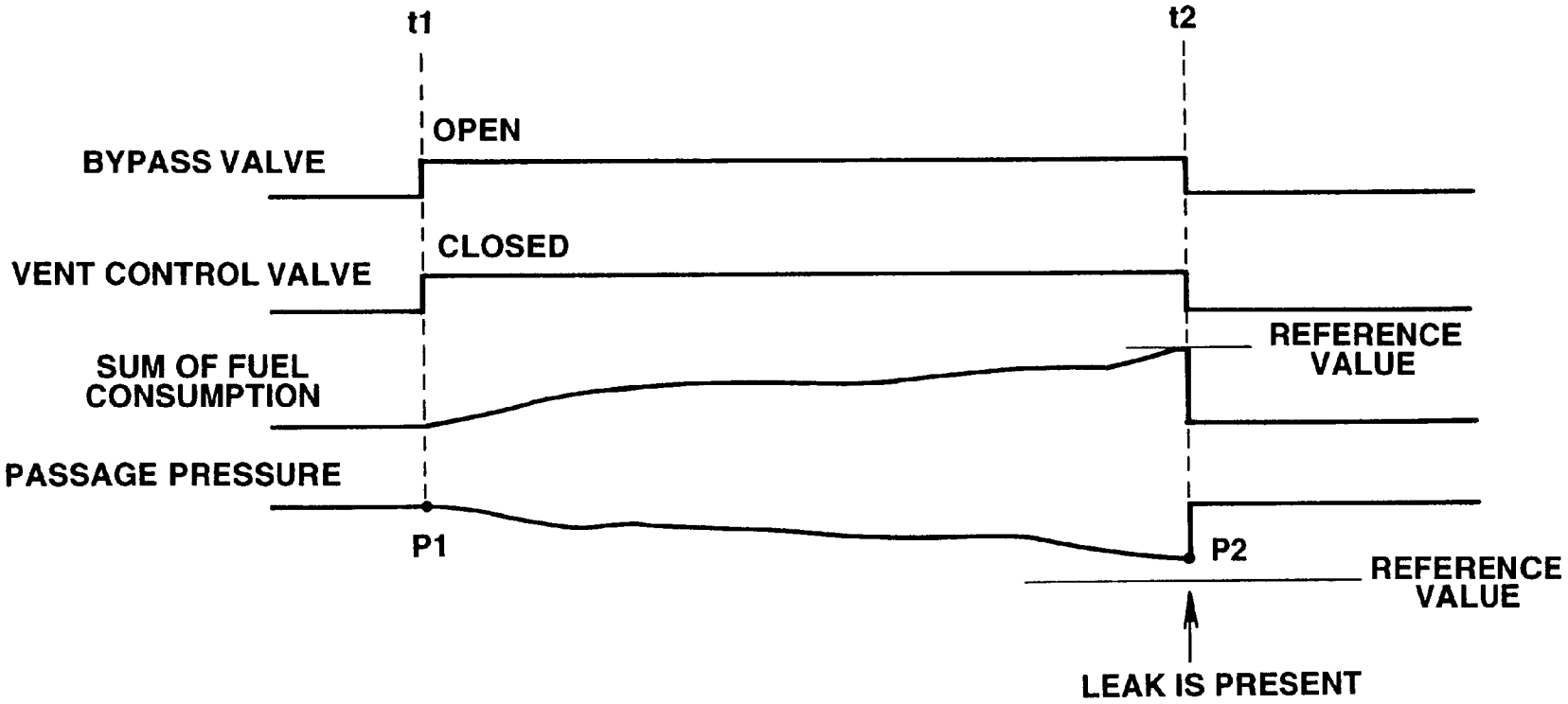
FIG. 4 is a timing chart showing a variation of passage pressure when it is judged that a leak is present in the evaporative emission control system, together with operations of valves and a variation of fuel consumption.

Referring to FIG. 4, the process for leak detection executed under control of the control unit 21 will be described.

(1) The purge control valve 11 is held fully closed immediately after the engine starts. At the time t1 immediately after the engine starts, the pressure in the fuel vapor flow passage 10 extending from the fuel tank 1 to the purge control valve 1 is sampled as P1. Thereafter, the vent control valve 12 is closed and the bypass valve 14 is opened. By these operations, the fuel vapor flow passage 10 extending from the fuel tank 1 to the purge control valve 11 establishes communication throughout thereof while being closed so as to be in the form of a closed space.

(2) From the time t1, calculation of the sum of fuel in the fuel tank 1 starts. By the consumption of fuel, there is developed in the fuel vapor flow passage 10 in the form of a closed space a pressure lower than the atmospheric pressure (i.e., a negative pressure). This will be described in detail hereinafter.

Under ordinary conditions in which the vent control valve 12 is fully open (i.e., at the time other than the time when the leak detection is carried out), it never occurs that the pressure in the fuel tank 1 becomes negative. This is because the vacuum cut valve 3 opens to draw the atmospheric air into the fuel tank 1 as soon as the pressure in the fuel tank becomes negative.

On the other hand, with an electronic fuel-injection system, a fuel pump (not shown) delivers fuel from the fuel tank 1 into a fuel supply passage 31 to supply an injector 32 with fuel which is pressurized so as to have a constant pressure. The injector 32 provided to each cylinder receives an instruction from the control unit 21 and injects a predetermined amount of fuel intermittently so that an engine torque in accordance with a driving condition is obtained. The consumption of the fuel in the fuel tank 1 thus starts with start of the engine.

Accordingly, when the fuel in the fuel tank 1 is consumed under the condition in which the fuel vapor flow passage 10 extending from the fuel tank 1 to the purge control valve 11 is closed so as to be in the form of a closed space, the pressure in the closed fuel vapor flow passage 10 is lowered in accordance with the fuel consumption as shown in the lowest part of FIG. 4. In the meantime, though a negative pressure is developed in the inside of the fuel tank 1, it is only smaller than the atmospheric pressure by several millimeters of mercury.

(3) At the time t2 at which the calculated sum of consumption of fuel in the fuel tank 1 exceeds a reference value, the pressure in the fuel vapor flow passage 10 is sampled as P2 (P2<P1). Then, the variation ΔP (=P1−P2) is calculated.

In this connection, in comparison between the case where there is a leak in the fuel vapor flow passage 10 extending from the fuel tank 1 to the purge control valve 11 and the case where there is not any leak in the fuel vapor flow passage 10, a smaller reduction ΔP results in the case where there is a leak.

Accordingly, by comparing the reduction with the reference value for judgment, it is possible to judge that there is a leak in the passage when ΔP is smaller than the reference value (refer to the lowest part of FIG. 4) and there is not any leak when ΔP is equal to or larger than the reference value.

(4) The vent control valve 12 is opened and the bypass valve 14 is closed, whereby to complete the leak detection of the evaporative emission control system.

Figure 5:
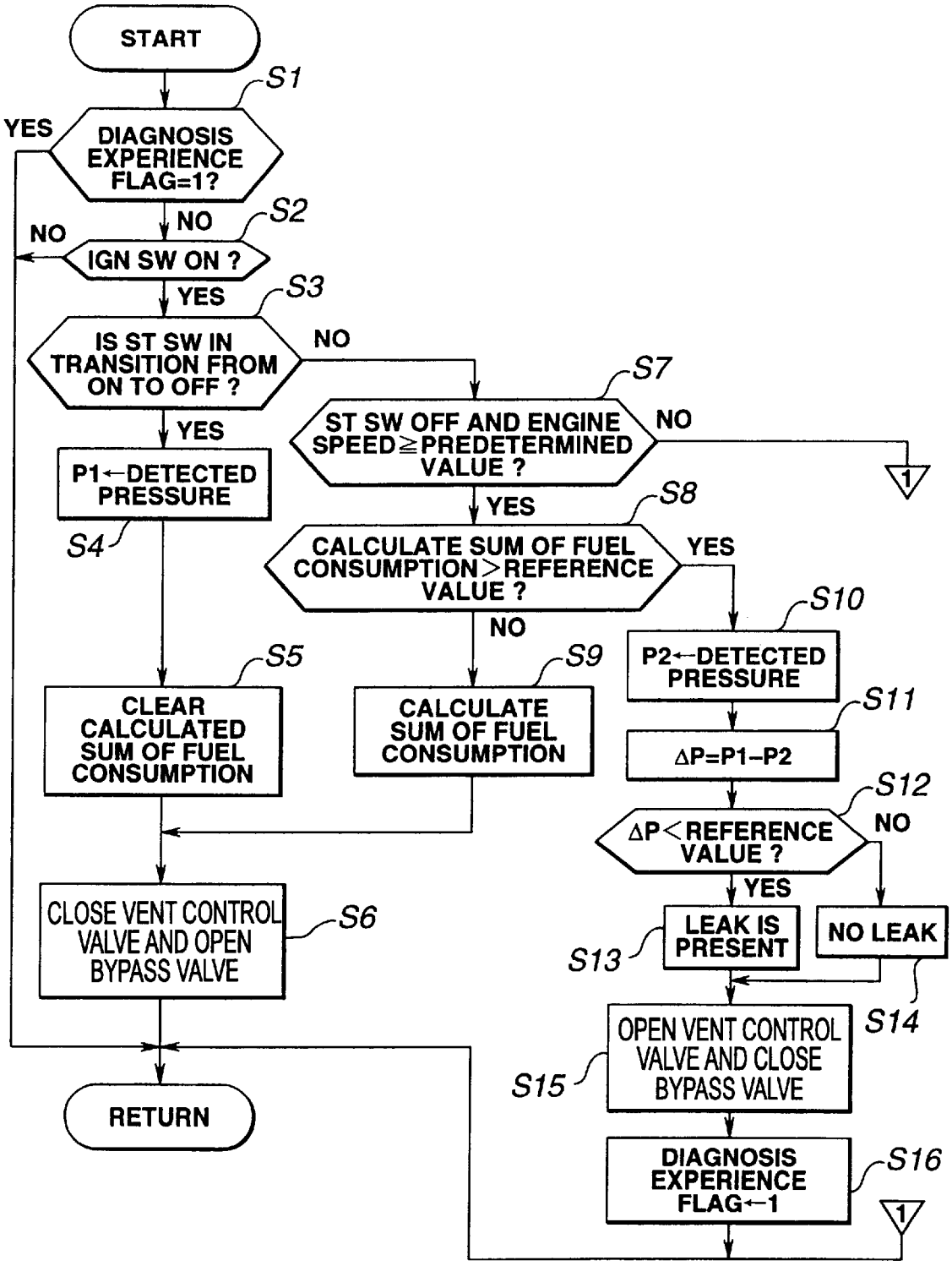
FIG. 5 is a flowchart illustrating a routine for detecting a leak, executed by the apparatus of FIG. 1.

The flowchart of FIG. 5 is a routine for executing the above described process for leak detection or diagnosis.

At the step S1, a diagnosis experience flag is looked. As will be described hereinlater, the flag is set to "1" when leak detection at this time of operation is completed. Since the flag is set to "0" when the leak detection is not executed immediately after the engine starts, the program proceeds to the steps S2 and S3 to look an ignition switch (abbreviated as ING SW) and a starter switch (abbreviated as ST SW). If the ignition switch is ON and the starter switch is at the transition from ON to OFF (i.e., if it is immediately after the engine starts), the program proceeds to steps S4, S5 and S6. At the step S4, the detected value by the pressure sensor 13 is transferred to P1. At the step S5 the calculated sum of consumption of fuel in the fuel tank 1 is cleared. Thereafter, at the step S6, the vent control valve 12 is closed and the bypass valve 14 is opened. At this time, the purge control valve 11 is in a fully closed condition.

From the next execution of the program onward, the program proceeds from the step S3 to the step S7. At the step S7, the starter switch and the engine speed are looked. When the starter switch is OFF and the engine speed is equal to or higher than a predetermined value, it is judged that engine is running and the program proceeds to the step S8. At the step S8, the sum of consumption of fuel in the fuel tank 1 is compared with the reference value. So long as the sum of fuel consumption is equal to or smaller than the reference value, the program proceeds to the step S9 to calculate the sum of consumption of fuel in the fuel tank 1 and then to the step S6 to continue the operation thereat. Repeated calculation of the sum of fuel consumption at the step S9 soon causes the sum of consumption of fuel in the fuel tank 1 to exceed the reference value, at which timing the program proceeds from the step S8 to the step S10.

At the step S10, the detected value by the pressure sensor 13 is transferred to P2. Then, at the step S11, the amount of pressure reduction ΔP (=P1−P2) is calculated. The amount of pressure reduction ΔP is compared with the reference value (which differs from the reference value at the step S8). When ΔP is larger than the reference value, the program proceeds to the step S14 and it is judged that there is no leak in the passage. On the other hand, when ΔP is equal to or smaller than the reference value, the program proceeds to the step S13 and it is judged that there is a leak in the passage.

At the step S15, the vent control valve 12 is opened and the bypass valve 14 is closed. At the step S16, diagnosis experience flag is set to "1". By the diagnosis experience flag which is set to "1", the program never proceeds to the step S2.

From the foregoing, it will be understood that according to the embodiment of the present invention the passage extending from the fuel tank 1 to the purge control valve 11 is closed so as to be in the form of a closed space immediately after the engine starts, the above described closed space is negatively pressurized so that the pressure therewithin is negative, by consumption of fuel in the fuel tank 1, the variation ΔP of the pressure in the closed space with respect to the pressure in the passage before closed so as to be in the form of the closed space is calculated, and the detection of leak is carried out on the basis of the variation ΔP. Since the purge control valve 11 is not opened during the detection of leak, it never occurs that the mixture of air and fuel vapors which exists in the fuel vapor flow passage 10 extending from the fuel tank 1 to the purge control valve 11 flows into the intake pipe, whereby it becomes possible to prevent a variation of the air-fuel ratio which is otherwise caused by a prior art leak detection.

It will be further understood that according to the present invention it becomes possible to carry out a leak detection immediately after the engine starts, i.e., before the feedback control of the air-fuel ratio starts.

The entire content of Japanese Patent Application P10-109395 (filed on Apr. 20, 1998) is incorporated herein by reference.

Although the invention has been described above by reference to a certain embodiment of the invention, the invention is not limited to the embodiment described above.

Figure 6:
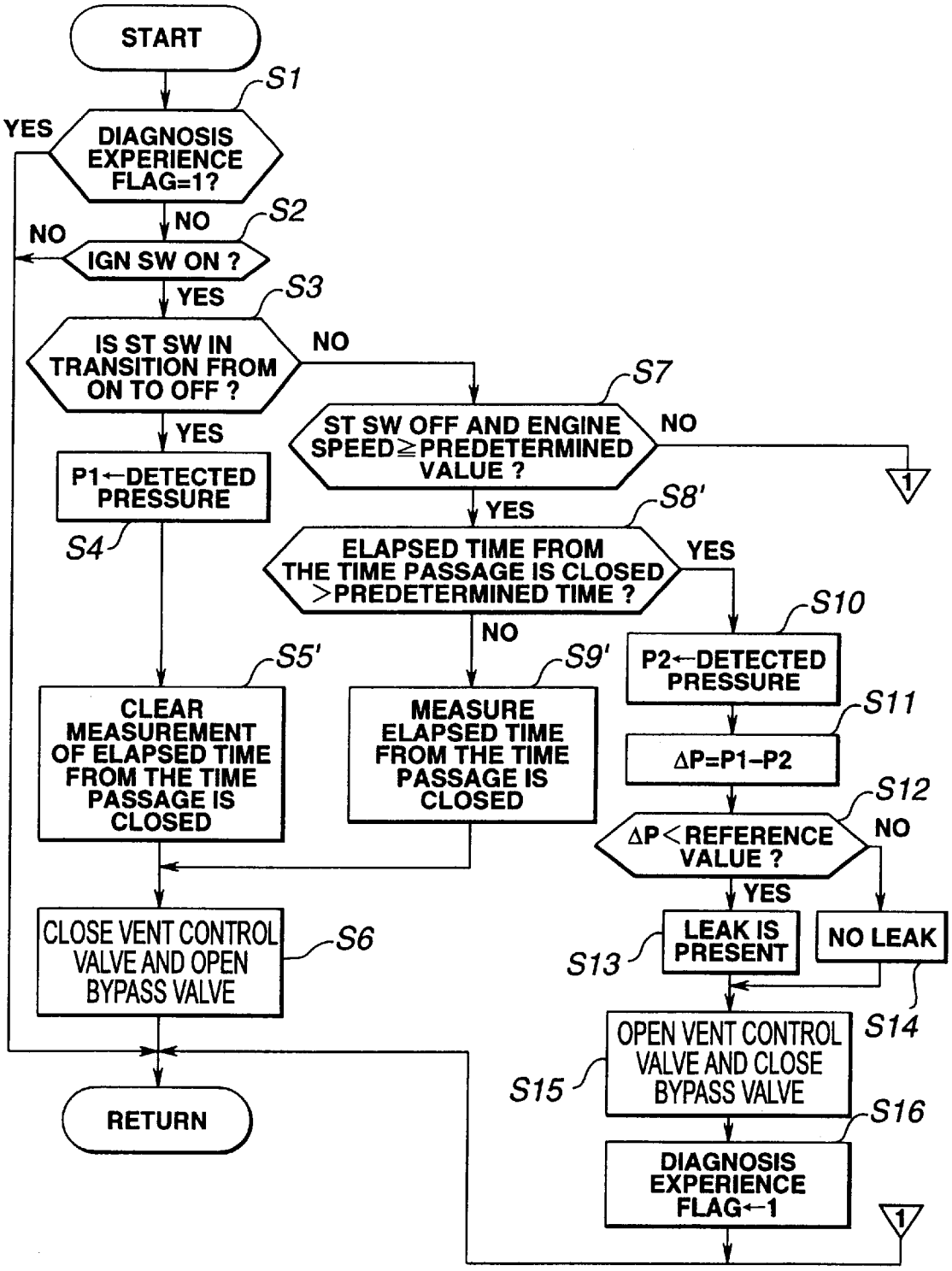
FIG. 6 is a flowchart illustrating a modification of the routine of FIG. 5.

Modifications and variations of the embodiment described above will occur to those skilled in the art, in light of the above teachings. For example, while in the above described embodiment of the present invention the leak detection is executed at the time the sum of consumption of fuel in the fuel tank, of which calculation starts immediately after the engine starts, exceeds a reference value, it can be executed at the time a predetermined period elapses from the time immediately after the engine starts as shown in the flowchart in FIG. 6. In the modified routine in FIG. 6, the steps S5', S8' and S9' are executed in place of the steps S5, S8 and S9 in the routine in FIG. 5, respectively.

However, the sum of fuel consumption, of which calculation is executed from the time immediately after the engine starts, varies depending upon a variation of the coolant temperature at the time the engine starts. Thus, in case the elapsed time starting from the time immediately after the engine starts is used, the above described pressure variation $\Delta P$ varies depending upon a variation of the coolant temperature at the time the engine starts, thus deteriorating the accuracy of leak detection by the corresponding degree.

In contrast to this, in case the sum of consumption of fuel in the fuel tank is used for the leak detection, it becomes easier to set the reference value which is used for comparison with the sum of the fuel consumption and furthermore the accuracy of leak detection can be improved. This is because there is a constant relation between the sum of consumption of fuel in the fuel tank and the negative pressurization of the passage.

What is claimed is:

1. An apparatus for detecting a leak in an evaporative emission control system for an internal combustion engine including a fuel tank, a canister for collecting fuel vapors from the fuel tank, a vacuum cut valve that is disposed between the fuel tank and the canister and opens and closes in response to the pressure within the fuel tank, and a purge control valve disposed between the canister and an intake pipe for controlling the flow of the fuel vapors from the canister to the intake pipe such that a fuel vapor flow passage is provided which extends from the fuel tank to the purge control valve by way of the canister, the apparatus comprising:

a vent control valve that selectively opens and closes an atmospheric vent of the canister;

a bypass valve that is disposed in parallel relation to the vacuum cut valve and selectively provides communication between the fuel tank and the canister;

an actuating device that actuates the vent control valve to close and the bypass valve to open immediately after the engine starts with the purge control valve in a fully closed condition and thereby establishing communication between the fuel tank and the purge control valve through the fuel vapor flow passage and closing the fuel vapor flow passage in a way as to prevent communication between an inside and outside of the fuel vapor flow passage;

a pressure sensor that detects a pressure in the fuel vapor flow passage; and a diagnostic device that detects a leak on the basis of the pressure in the fuel vapor flow passage wherein, when the fuel vapor flow passage is closed, the pressure in the fuel vapor flow passage decreases with an increase of consumption of fuel in the fuel tank without introducing a negative pressure produced in the intake pipe into the fuel vapor flow passage.

2. An apparatus according to claim 1, wherein the diagnostic device comprises a control unit including a first control section that measures an elapsed time elapsing from the time the fuel vapor flow passage is closed, a second control section that judges whether the elapsed time measured by the first control section exceeds a reference value or not, a third control section that calculates, when the elapsed time is judged by the second diagnostic section as exceeding the reference value, a variation of the pressure in the fuel vapor flow passage caused from start of measurement of the elapsed time, a fourth control section that judges whether the variation of the pressure in the fuel vapor flow passage calculated by the third control section is equal to or larger than a reference value, and a fifth control section that judges that there is a leak when the variation of the pressure in the fuel vapor flow passage is judged as being smaller than a reference value.

3. An apparatus according to claim 1, wherein the diagnostic device comprises a control unit including a first control section that calculates the sum of consumption of fuel in the fuel tank from the time the fuel vapor flow passage is closed, a second control section that judges whether the sum of fuel consumption exceeds a reference value or not, a third control section that calculates, when the sum of fuel consumption is judged by the second control section as exceeding the reference value, a variation of the pressure in the fuel vapor flow passage caused from start of the calculation of the sum of fuel consumption, a fourth control section that judges whether the variation of the pressure in the fuel vapor flow passage calculated by the third control section is equal to or larger than a reference value, and a fifth control section that judges that there is a leak when the variation of the pressure in the fuel vapor flow passage is judged as being smaller than a reference value.

4. An apparatus for detecting a leak in an evaporative emission control system for an internal combustion engine including a fuel tank, a canister for collecting fuel vapors from the fuel tank, a vacuum cut valve that is disposed between the fuel tank and the canister and opens and closes in response to the pressure within the fuel tank, and a purge control valve disposed between the canister and an intake pipe for controlling flow of the fuel vapors from the canister to the intake pipe such that a fuel vapor flow passage is provided which extends from the fuel tank to the purge control valve by way of the canister, the apparatus comprising:

a vent control valve for selectively opening and closing an atmospheric vent of the canister;

a bypass valve that is disposed in parallel relation to the vacuum cut valve and selectively provides communication between the fuel tank and the canister;

actuating means for actuating the vent control valve to close and the bypass valve to open immediately after the engine starts with the purge control valve in a fully closed condition and thereby establishing communication between the fuel tank and the purge control valve through the fuel vapor flow passage and closing the fuel vapor flow passage in a way as to prevent communication between an inside and outside of the fuel vapor flow passage;

pressure detecting means for detecting a pressure in the fuel vapor flow passage; and leak detecting means for detecting a leak on the basis of the pressure in the fuel vapor flow passage wherein, when the fuel vapor flow passage is closed, the pressure in the fuel vapor flow passage decreases with an increase of consumption of fuel in the fuel tank without introducing a negative pressure produced in the intake pipe into the fuel vapor flow passage.

5. An apparatus according to claim 4, wherein the leak detection means comprises first means for measuring an elapsed time elapsing from the time the fuel vapor flow passage is closed, second means for judging whether the elapsed time measured by the first means exceeds a reference value or not, third means for calculating, when the elapsed time is judged by the second means as exceeding the reference value, a variation of the pressure in the fuel vapor flow passage caused from start of measurement of the elapsed time, fourth means for judging whether the variation of the pressure in the fuel vapor flow passage calculated by the third means is equal to or larger than a reference value, and fifth means for judging that there is a leak when the variation of the pressure in the fuel vapor flow passage is judged as being smaller than a reference value.

6. An apparatus according to claim 4, wherein the leak detection means comprises first means for calculating the sum of consumption of fuel in the fuel tank from the time the fuel vapor flow passage is closed, second means for judging whether the sum of fuel consumption exceeds a reference value or not, third means for calculating, when the sum of fuel consumption is judged by the second means as exceeding the reference value, a variation of the pressure in the fuel vapor flow passage caused from start of the calculation of the sum of fuel consumption, fourth means for judging whether the variation of the pressure in the fuel vapor flow passage calculated by the third means is equal to or larger than a reference value, and fifth means for judging that there is a leak when the variation of the pressure in the fuel vapor flow passage is judged as being smaller than a reference value.

7. A diagnostic apparatus of an evaporative emission control system for an engine comprising:

a fuel tank;

a canister that collects fuel vapors in the fuel tank;

a vacuum cut valve that is disposed between the fuel tank and the canister and opens and closes in response to the pressure within the fuel tank;

a purge control valve that controls flow of fuel vapors purged from the canister to an intake pipe of the engine;

a vent control valve disposed at an atmospheric vent of the canister;

a bypass valve that is disposed in parallel relation to the vacuum cut valve and selectively provides communication between the fuel tank and the canister:

a pressure sensor that detects a pressure of a closed space achieved by closing the purge control valve and the vent control valve; and a controller that detects a malfunction of the evaporative emission control system on the basis of the pressure detected by the pressure sensor wherein, when the closed space is achieved, the pressure in the closed space decreases with an increase of consumption of fuel in the fuel tank without introducing a negative pressure produced in the intake pipe into the closed space.

8. A diagnostic apparatus according to claim 7, further comprising an injector that injects fuel in the fuel tank when the engine is running.

9. A diagnostic apparatus according to claim 7, wherein the pressure sensor is arranged between the canister and the purge control valve.

10. A diagnostic apparatus according to claim 7, wherein the pressure sensor is arranged at the fuel tank.

11. A diagnostic apparatus according to claim 7, wherein the closed space is achieved immediately after start of the engine.

12. A diagnostic apparatus according to claim 7, wherein the controller includes:

a first section that measures an elapse time after the closed space is achieved;

a second section that calculates a variation of the pressure during the elapse time when the elapse time has exceeded a reference time; and a third section that judges that a malfunction has occurred when the variation of the pressure calculated in the second section is smaller than a reference value.

13. A diagnostic apparatus according to claim 7, wherein the controller includes:

a first section that calculates the sum of fuel consumption in the fuel tank after the closed spaced is achieved;

a second section that calculates a variation of the pressure during the calculation of the sum of fuel consumption when the sum of fuel consumption has exceeded a reference amount; and a third section that judges that a malfunction has occurred when the variation of the pressure calculated in the second section is smaller than a reference value.

* * * * *